US005535650A

United States Patent [19]

McNatt

[11] Patent Number: 5,535,650

[45] Date of Patent: Jul. 16, 1996

[54] ADJUSTABLE PLIER WRENCH HAND TOOL

[76] Inventor: Stanley L. McNatt, 5915 Guettermann Ehler Rd., Muldoon, Tex. 78949-5131

[21] Appl. No.: 368,859

[22] Filed: Jan. 5, 1995

[51] Int. Cl.[6] ..... B25B 7/12

[52] U.S. Cl. ..... 81/361; 81/165

[58] Field of Search ..... 81/173, 175, 361, 81/165, 134, 138, 139, 140, 356, 358

[56] References Cited

U.S. PATENT DOCUMENTS

| | | | |
|---|---|---|---|
| 1,305,628 | 6/1919 | Statham | 81/361 |
| 1,490,903 | 4/1924 | Anderson | 81/361 |
| 3,190,154 | 6/1965 | Chapman | 81/165 |
| 3,422,707 | 1/1969 | York | 81/361 |
| 3,664,214 | 5/1972 | Feldman | 81/130 |
| 4,375,174 | 3/1983 | Shanley, Jr. | 81/165 |
| 4,477,937 | 10/1984 | Costello | 7/139 |
| 5,150,488 | 9/1992 | Yuan et al. | 7/137 |

FOREIGN PATENT DOCUMENTS

| | | | |
|---|---|---|---|
| 553556 | 12/1956 | Italy | 81/165 |

OTHER PUBLICATIONS

"Wrench Meet Vise", Popular Mechanics, Nov. 1994, p. 26 & Applicant's Comments.

*Primary Examiner*—Bruce M. Kisliuk

*Assistant Examiner*—Joni B. Danganan

*Attorney, Agent, or Firm*—Richard L. Miller

[57] ABSTRACT

The invention is an adjustable plier wrench hand tool, combining the useful functions of standard adjustable wrenches with standard vise grip pliers. The invention has a main body, a plier handle having a plier handle head, and an upper and lower jaw. The lower jaw is slidably mounted to the main body and capable of moving towards and away from the upper jaw. A thumbscrew is threaded and mated to corresponding teeth on a rack integrally formed with the lower jaw, such that by rotating the thumbscrew, the lower jaw moves towards and away from the upper jaw. The thumbscrew has a bore through which a stub shaft, extends from which a cam, protrudes. By bringing the plier handle into a closed position, an apex of the plier handle head pushes against a cam surface of the cam, forcing the cam, the thumbscrew, and hence the lower jaw upwards, in effect causing a compression between the lower jaw and the upper jaw, so as to firmly grip an object typically a nut.

5 Claims, 1 Drawing Sheet

ADJUSTABLE PLIER WRENCH HAND TOOL

BACKGROUND OF THE INVENTION

The invention relates to an adjustable plier wrench hand tool. More particularly, the invention relates to a combination vise grip plier and adjustable wrench.

Adjustable wrenches have often been utilized in situations where one was not in possession of fixed size wrenches or ratchets, or where the size of the nut or bolt being worked on deviated from standard metric or English sizes. The traditional adjustable wrench allows the user to adjust the jaw size of the wrench jaws to fit a large variation of nut or bolt sizes, in the event that, as mentioned above, the user is not in possession of fixed sized ratchets or wrenches or the nut or bolt size being worked on is of a non-standard size. Because of the precise sizes that adjustable wrenches can be adjusted to, adjustable wrenches have proven extra worthy when working on delicate, malleable parts, such as nuts or bolts made of aluminum, titanium, etc.

Vise grip pliers have commonly been utilized when a substantial amount of gripping force was needed to securely lock an object between the jaws of the vise grip, such as when one attempts to remove a stubborn or frozen nut or bolt without stripping its head. Also, due to the extreme gripping power of vise grip pliers, they are similarly well suited for squeezing sheet metal flanges and seams together during welding.

Traditionally, adjustable wrenches and vise grip pliers have been manufactured separately, requiring both to be carried along to any job which might call for substantial gripping force in addition to adjustability. This often proved cumbersome and inefficient. In an attempt to combat this problem, several combination vise grip plier-adjustable wrenches have been developed.

Attempted solutions in the art at combining adjustable wrenches and vise grip pliers together into one tool have proven unsuccessful. U.S. Pat. No. 5,150,488 to Yuan et al., and U.S. Pat. No. 4,477,937 to Costello, while both disclosing combination adjustable wrench-vise grip pliers, fail to truly provide a combination tool possessing the unique attributes of both. In using either of these apparatus, one must usually squeeze the vise grip handle in order to utilize the adjustable wrench function. It is often not possible to utilize only the adjustable wrench aspect of the tool without also engaging the vise grip plier handle. Also, U.S. Pat. No. 4,477,937 to Costello, like traditional vise grip pliers, requires the use of two hands in order to adjust the size of the wrench jaws.

While vise grip pliers, similar to adjustable wrenches, provide assistance when encountered with non-standard sized nuts and bolts, vise grip pliers are unable to perform well on delicate parts, as their substantial gripping force often mars and mangles soft surfaces. Likewise, traditional adjustable wrenches are incapable of providing a substantial enough grip to combat a stubborn or frozen nut or bolt.

While these units may be suitable for the particular purpose employed, or for general use, they would not be as suitable for the purposes of the present invention as disclosed hereafter.

SUMMARY OF THE INVENTION

It is an object of the invention to produce an adjustable plier wrench hand tool.

It is another object of the invention to produce an adjustable plier wrench hand tool which comprises a combination of traditional vise grips and adjustable wrenches.

It is further object of the invention to produce a tool which allows the user to adjust the jaw size of the wrench to fit a large variation of nut or bolt sizes in the event that the nut or bolt being worked on deviates from standard metric or English sizes.

It is a still further object of the invention to produce a tool which provides a substantial amount of gripping force for securely locking an object between the jaws of the tool, such as when one attempts to remove a stubborn or frozen nut or bolt without stripping its head.

It is a still further object of the invention to produce an adjustable plier hand tool which allows its adjustable wrench functions to be utilized independently of its vise grip plier functions, and which also is capable of having its jaws adjusted with the use of only one hand, via a thumbscrew.

The invention is an adjustable plier wrench hand tool, combining the useful functions of standard adjustable wrenches with standard vise grip pliers. The invention has a main body, a plier handle having a plier handle head, and an upper and lower jaw. The lower jaw is slidably mounted to the main body and capable of moving towards and away from the upper jaw. A thumbscrew is threaded and mated to corresponding teeth of a gear rack integrally formed on the lower jaw, such that by rotating the thumbscrew, the lower jaw moves towards and away from the upper jaw. The thumbscrew has a bore through which a stub shaft cooperates with. A cam is integrally formed with and protrudes from the stub shaft. By bringing the plier handle into a closed position, an apex of the plier handle head pushes against a cam surface of the cam, forcing the cam, the thumbscrew, and hence the lower jaw upwards, in effect causing a compression of the space between the lower jaw and the upper jaw, so as to firmly grip an object such as a bolt.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
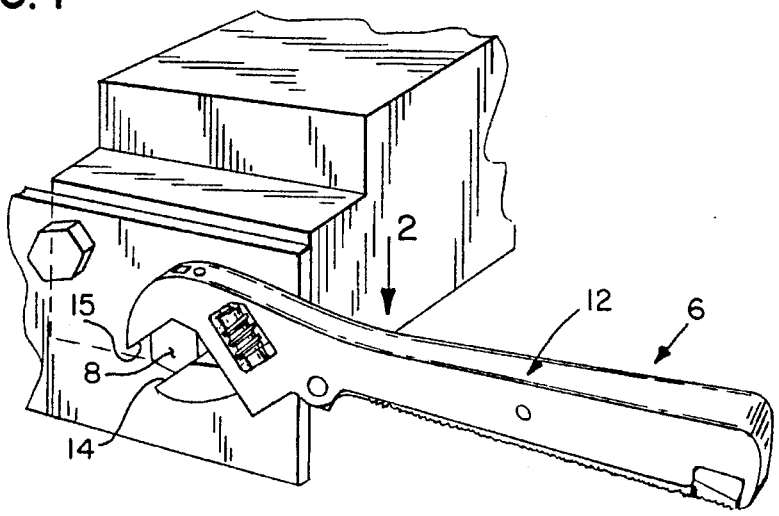
FIG. 1 is a diagrammatic perspective view illustrating the instant invention in use.
Figure 2:
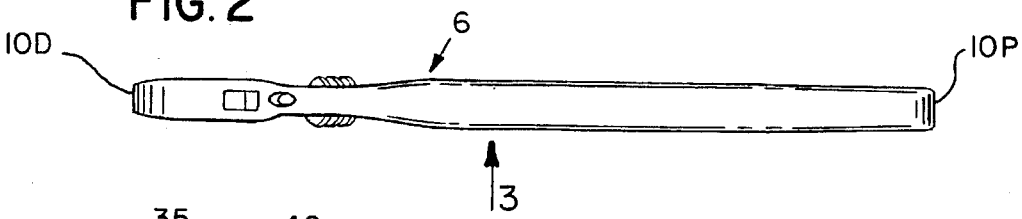
FIG. 2 is an enlarged top plan view taken on arrow 2 in FIG. 1 of just the instant invention per se.

FIGS. 1 and 2 illustrate an adjustable plier wrench 6 being used upon a bolt 8. The adjustable plier wrench 6 has a proximal end 10P and a distal end 10D. The adjustable plier wrench 6 also has a main body 12, and a lower jaw 14 which is slidably mounted to the main body 12. The main body 12 also has an upper jaw 15 which is fixed to said main body 12. Both the upper jaw 15 and lower jaw 14 are located at the distal end 10D of the adjustable plier wrench 6.

Figure 3:
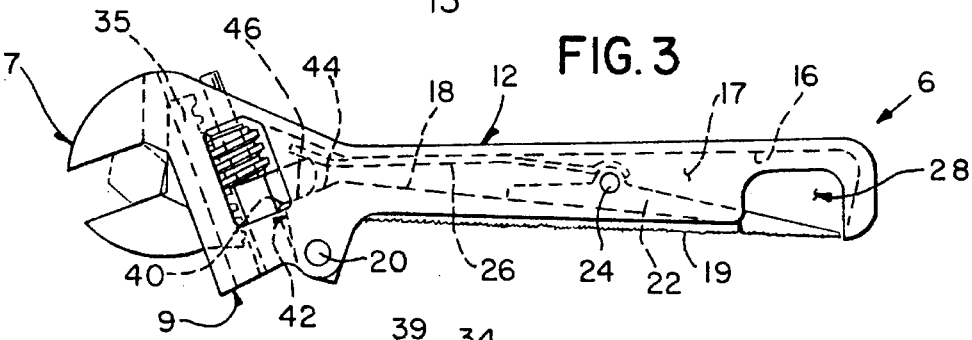
FIG. 3 is a diagrammatic side elevational view taken in the direction of arrow 3 in FIG. 2 showing the instant invention in a closed locked position and illustrating some of the internal mechanisms in dotted lines.
Figure 4:
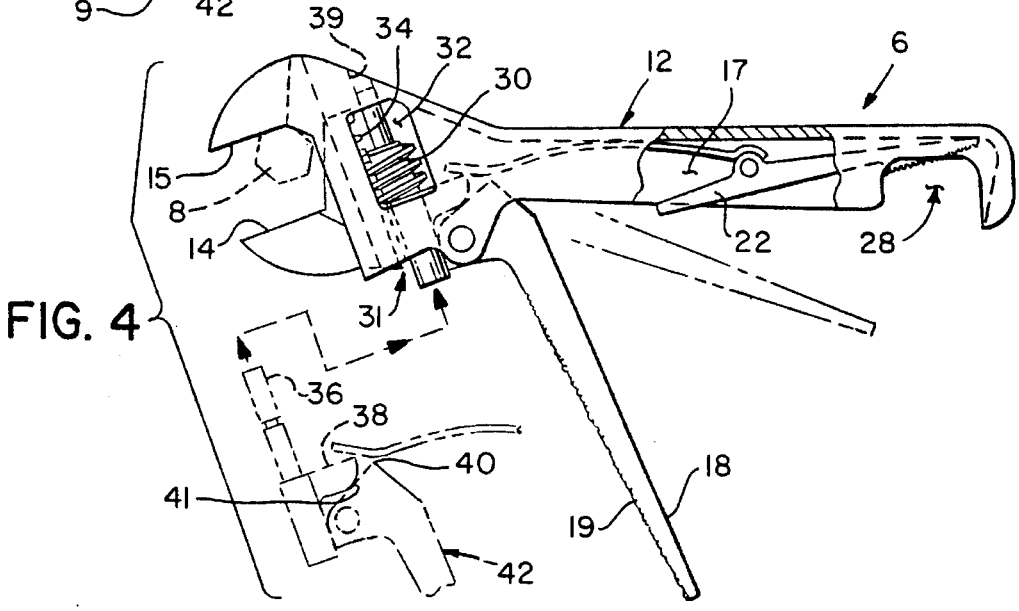
FIG. 4 is a diagrammatic side elevational view partially in section similar to FIG. 3 taken in the direction of arrow 3 in FIG. 2 showing the instant invention in an open position, and with some parts in phantom exploded away therefrom.

FIG. 3 illustrates certain details of the adjustable plier wrench 6. The main body 12 has a top 7 and a bottom 9, as well as an open hollow 17 on said bottom 9 within which a plier handle 18 and plier handle hinge pin 20 are contained. The plier handle 18 is held in place by, and pivots about the plier handle hinge pin 20 which extends through the main body 12 and then through the plier handle 18. The plier handle 18 also has a plier handle head 42 located at the distal end 10D of the adjustable plier wrench 6. In FIG. 3, the plier handle 18 is in the closed position, and is fully contained within the open hollow 17 of the main body 12. While in the closed position, the plier handle 18 is substantially parallel to the main body 12. The plier handle 18 has ridges 19 along its surface so that a person operating it can firmly grasp it. A spine 16 extends along the top 7 of the main body 12 within the open hollow 17 to provide extra rigidity to the main body 12. A release lever 22 is also contained within the open space 17 of the main body 12, and is held in place by and pivots about a release lever pin 24 which extends through the main body 12, and then through the release lever 22. By depressing the portion of the release lever 22 which is exposed in an indentation 28 in the main body 12, the release lever 22 pivots about the release lever pin 24, causing the plier handle 18 to pivot about the plier handle hinge pin 20 and move from the closed position depicted in FIG. 3, into an open position, as best seen in FIG. 4. While in the open position, the plier handle 18 is relatively perpendicular to the main body 12.

As illustrated in FIG. 4, the apparatus has collection of parts, some of which are shown separately in phantom, forming an adjustment assembly, for adjusting the relative position of the upper jaw 15 and lower jaw 14. The adjustment assembly has a thumbscrew 30 which is exposed in an adjustment window 32 in the main body 12. The thumb screw 30 is threaded, the threads mating with teeth 34 of a rack 35 integrally formed on the lower jaw 14. As seen in the view in phantom of parts exploded, the adjustment assembly 31 further comprises a stub shaft 36 extending through a bore in the thumbscrew 30. After exiting the bore in the thumbscrew 30, the stub shaft 36 further extends through and is held in place by a channel opening 39 which is located at the top 7 of the main body 12. A cam 38 protrudes and is fixed to the stub shaft 36. When turned, the thumbscrew 30 acts as a worm gear, meshing with the teeth 34 of the rack 35 formed on the lower jaw 14, moving the lower jaw 14 toward or away from the upper jaw 15. This operation of adjusting the lower jaw 14 can be performed regardless of whether the plier handle 18 is in the open or closed position.

When the plier handle 18 is brought from the open to the closed position, an apex 40 of the plier handle head 42 pushes against a cam surface 41 of the cam 38, thus forcing the cam 38 up towards the top 7 of the main body 12. As the cam 38 travels upward, it forces the thumbscrew 30 upwards also. Since the thumbscrew 30 is threaded and said threads are mated with the teeth 34 of the rack 35 formed on the lower jaw 14, the upward travel of the thumbscrew 30 causes the lower jaw 14 to similarly travel upward, in effect causing a compression of the space between the lower jaw 14 and the upper jaw 15, so as to firmly grip an object such as a bolt 8.

When the plier handle 18 is fully in the closed position, as best seen by referring back to FIG. 3, a plier handle head flat section 44 fits tightly against a cam flat section 46, firmly locking the lower jaw 14 in place. Finally, it can be seen that a leaf spring 26 extends from the release lever 22, along the spine 16, and presses against the cam 38. The purpose of the leaf spring 26 is to apply downward pressure on the cam 38, so that when force is applied to the release lever 22, the plier handle 18 easily ejects from the open space 17, into the open position.

What is claimed is:

1. An adjustable plier wrench, comprising:

a) a proximal end and a distal end;

b) an upper jaw and a lower jaw located at said distal end, said lower jaw capable of moving towards and away from said upper jaw said lower jaw having a rack with teeth;

c) a main body having a top, an adjustment window, and a bottom, an open hollow on its bottom within which a plier handle is located, said plier handle fastened to the main body by a plier handle hinge pin which extends through the main body and then through the plier handle, the plier handle pivoting about the plier handle hinge pin to close the lower jaw against the upper jaw;

d) an adjustment assembly, for adjusting the relative position of the upper jaw and lower jaw, the adjustment assembly comprising a threaded thumbscrew exposed in the adjustment window, said threads of said thumbscrew mating with the teeth of said rack on the lower jaw, the adjustment assembly further comprising a stub shaft extending through a bore in the center of the thumbscrew and a cam having a cam surface, the cam protruding from and being fixed to the stub shaft; and e) a plier handle head located at the distal end of the plier handle, said plier handle head having an apex.

2. The apparatus as recited in claim 1, further having a release lever contained within the open hollow of the main body which is held in place by and pivots about a release lever pin which extends through the main body and then through the release lever, such that by depressing the portion of the release lever which is exposed in an indentation in the main body, the plier handle is caused to move from a closed position where it is substantially parallel to the main body, into an open position where it is relatively perpendicular to the main body.

3. The apparatus as recited in claim 2, wherein the main body has a spine, and further comprising a leaf spring which extends from the release lever along the spine and presses against the cam such that the leaf spring applies downward pressure on the cam so that when force is applied to the release lever, the plier handle easily ejects from the closed position into the open position.

4. A method for locking the jaws of pliers together so as to firmly grip an object between them, wherein the pliers comprise a main body, a proximal and a distal end, an upper jaw and a lower jaw located at the distal end, said lower jaw slidably mounted to the main body and capable of moving towards and away from said upper jaw, said lower jaw having a rack with teeth, an adjustment assembly for adjusting the relative position of the upper and lower jaw wherein the adjustment assembly includes a cam with a cam flat surface and a cam surface, a plier handle, said plier handle fastened to the main body by a plier handle hinge pin which extends through the main body and then through the plier handle, the plier handle pivoting about the plier handle hinge pin and having a plier handle head which has a plier handle head flat section and an apex, a thumbscrew which is threaded, said threads mating with the teeth on the lower jaw for moving it with respect to the upper jaw, the adjustment assembly further comprising a stub shaft extending through a bore in the center of the thumbscrew comprising the steps of:

a) adjusting the relative position of the upper jaw and lower jaw by turning the thumbscrew so that the thumbscrew acts as a worm gear, meshing with the teeth of the rack on the lower jaw, moving the lower jaw toward and away from the upper jaw; and b) pivoting the plier handle about the plier handle hinge pin, bringing it from an open position where it is relatively perpendicular to the main body to a closed position where it is substantially parallel to the main body, so that the plier handle head flat section fits tightly against the cam flat section, firmly locking the thumbscrew through which the stub shaft extends, and holding the lower jaw in place against the threads of the thumbscrew.

5. The method as recited in claim 4, wherein the step of bringing the plier handle from an open position to a closed position further comprises: grasping the object by pushing the apex of the plier handle head against the cam surface of the cam, forcing the cam up toward the top of the adjustable plier wrench as the cam travels upwards, forcing the thumbscrew upwards, transferring the upward motion of the thumbscrew from the threads of the thumbscrew to the teeth of the rack on the lower jaw, and compressing the object between the upper and lower jaw.

* * * * *